US006016950A

United States Patent [19]

Money

[11] Patent Number: 6,016,950

[45] Date of Patent: Jan. 25, 2000

[54] WRAPPER AND METHOD OF ITS MANUFACTURE

[75] Inventor: Julian David Kyrle Money, Richmond, United Kingdom

[73] Assignee: Pethick & Money Limited, United Kingdom

[21] Appl. No.: 08/983,494

[22] PCT Filed: Jul. 22, 1996

[86] PCT No.: PCT/GB96/01750

§ 371 Date: Apr. 30, 1998

§ 102(e) Date: Apr. 30, 1998

[87] PCT Pub. No.: WO97/03893

PCT Pub. Date: Feb. 6, 1997

[30] Foreign Application Priority Data

Jul. 21, 1995 [GB] United Kingdom ..... 9515172
Sep. 5, 1995 [GB] United Kingdom ..... 9518106

[51] Int. Cl.[7] ..... B65D 65/12; B65D 65/14

[52] U.S. Cl. ..... 229/87.01; 53/456; 53/459; 229/87.08; 229/938; 229/87.03; 383/120; 383/122; 493/189

[58] Field of Search ..... 229/87.01, 87.08, 229/87.11, 938, 87.03; 383/122, 120; 53/456, 464; 493/254, 189, 193–197

[56] References Cited

U.S. PATENT DOCUMENTS

| | | | |
|---|---|---|---|
| 2,070,736 | 2/1937 | Johnson | 229/87.01 |
| 2,628,764 | 2/1953 | Rubinstein et al. | 229/87.01 |
| 3,405,859 | 10/1968 | Phillips, Jr. | 383/122 |
| 3,537,360 | 11/1970 | Farnam | 53/456 |
| 4,575,000 | 3/1986 | Gordon | 229/87.01 |
| 4,754,914 | 7/1988 | Wischusen, III . | |
| 4,810,844 | 3/1989 | Anderson | 383/122 |
| 4,904,093 | 2/1990 | Woods et al. | 383/120 |
| 5,441,345 | 8/1995 | Garvey et al. | 383/120 |
| 5,468,206 | 11/1995 | Buchanan | 493/194 |
| 5,741,077 | 4/1998 | Sasaki et al. | 383/122 |

FOREIGN PATENT DOCUMENTS

| | | |
|---|---|---|
| 914744 | 10/1946 | France . |
| 1304366 | 8/1962 | France . |
| 254978 | 1/1949 | Switzerland . |

*Primary Examiner*—Stephen P. Garbe
*Attorney, Agent, or Firm*—Fish & Richardson P.C.

[57] ABSTRACT

A wrapper for an article includes a sheet of wrapping material folded to form a flat sleeve with an out-turned seam formed by edge portions of the sleeve extending along the center of one side of the sleeve. The edge portions are secured together at the ends of the sleeve and the sides of the sleeve are secured together along a line or lines which define, in a central region of the sleeve, the periphery of an enclosure. The enclosure can be opened by separating the edges of the seam in the central region of the sleeve to receive an article and then be closed together and the end portions of the sleeve wrapped around the article contained in the central region of the sleeve. A method is also described.

14 Claims, 13 Drawing Sheets

STAGE 1
SLIDE FINGERS IN TO
OPEN POUCH

STAGE 2
PULL SIDES OF POUCH APART
TO FORM A RECEPTACLE IN
WHICH TO PLACE PRODUCT

STAGE 3
FOLD SHORT FLAP OF PAPER
OVER LONG FLAP

STAGE4
FOLD DOWN AND WRAP
WINGS UNDERNEATH BASE

WRAPPER AND METHOD OF ITS MANUFACTURE

CROSS-REFERENCE TO RELATED APPLICATIONS

This application is a 371 of International Application Number PCT/GB96/01750, filed Jul. 22, 1996.

STATEMENT REGARDING FEDERALLY SPONSORED RESEARCH OR DEVELOPMENT

Not applicable.

BACKGROUND OF THE INVENTION

This invention relates to wrappers for articles formed from sheet material. The sheet material may comprise paper, coated paper, printed paper, card or plastics materials. The wrapper is intended to hold a variety of products such as burgers or other takeaway food, gifts, confectionary and items of clothing and may be used in a solely utilitarian form or as a gift wrapper.

SUMMARY OF THE INVENTION

The invention provides a wrapper for an article comprising a sheet of wrapping material folded to form a flat sleeve with an out-turned seam formed by edge portions of the sleeve extending along the centre of one side of the sleeve, said edge portions being secured together at the ends of the sleeve and the sides of the sleeve being secured together along a line or lines which define in a central region of the sleeve the periphery of an enclosure which can be opened by separating the edges of the seam in the central region of the sleeve to receive an article and then be closed together and the end portions of the sleeve wrapped around the article containing central region of the sleeve.

For example the sides of the sleeve may be secured along four spaced lines which define a generally diamond shaped periphery to the cavity More specifically the lines along which the sides of the sleeve are secured may be convexly curved to form the diamond shaped cavity with a rounded profile.

In any of the above arrangements the adhered parts of the sleeve may be secured together along said line or lines by bands of adhesive applied to one or both parts or the sleeve or by heat sealing with a coating applied to the paper with heat sealing properties.

Also in any of the above arrangements the sleeve may be formed from a rectangular sheet of wrapping material.

One of said edge portions of the blank may be arranged to extend beyond the other to facilitate separation of the edge portions for opening the cavity.

The invention also provides a method of forming a wrapper for an article comprising the steps of feeding a web of sheet material through a plurality of stations, applying adhesive to the web at spaced locations along one edge of the web and along pairs of curved convergent lines within the body of the web, folding the other side of the web so that an edge portion back extends beyond a centre line of the web, folding that edge portion back on itself in line with the centre line of the web, folding the adhesive carrying side of the web to form a flattened sleeve with the adhesive carrying edge of the web overlying said other edge portion of the web and pressing the edge portions and the sides of the web together to adhere the edge portions and the sides of the sleeve along said lines together and separating the folded wrapping from the web.

The invention further provides a method of forming a wrapper for an article comprising the steps of feeding a web of heat sealable sheet material through a plurality of stations, folding one side of the web so that an edge portion of the web extends beyond the centre line of the web, folding that edge portion back on itself in line with the centre line of the web, folding the other side of the web to form a flattened sleeve with the edge portions of the web overlying each other, heat sealing the ends of the edge portions together and heat sealing the sides of the sleeve together along a line or lines in the central region of the sleeve to define the periphery of a cavity within the sleeve.

BRIEF DESCRIPTION OF THE DRAWINGS

The following is a description of some specific embodiments of the invention, reference being made to the accompanying drawings in which.

DESCRIPTION OF THE PREFERRED EMBODIMENT

Figure 1:
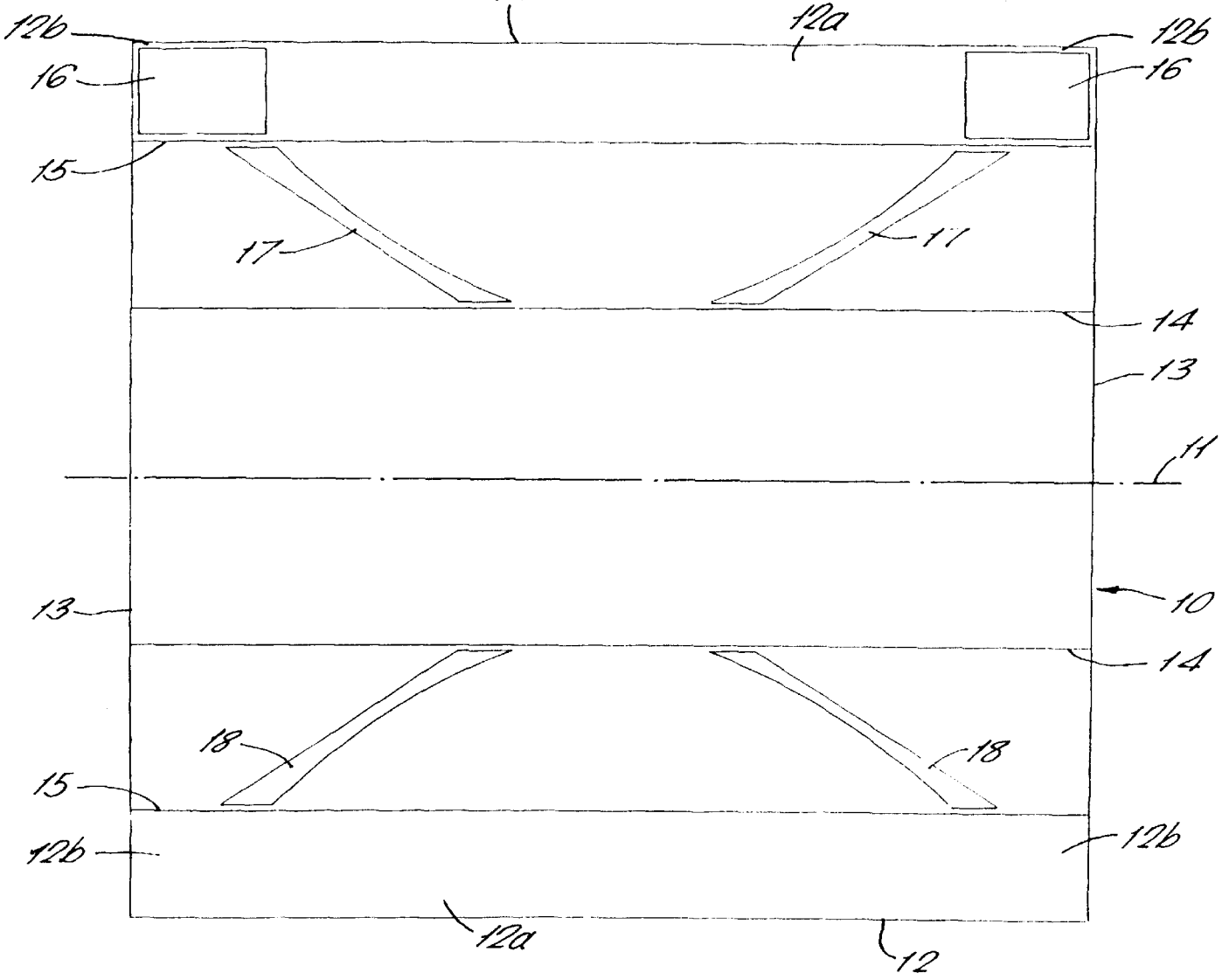
FIG. 1 shows a square blank of wrapping material with lines indicating where the blank is to be folded and areas indicating where adhesive is to be applied.

FIG. 1 of the drawings shows a rectangular blank 10 of sheet material such as paper having a centre line 11, side edges 12 and end edges 13. An inner pair of fold lines are indicated at 14 on the blank disposed symmetrically to and parallel with the centre line 11 and an outer pair of fold lines 15 again disposed symmetrically with and parallel to the centre line 11 adjacent the outer edges 14 of the blank.

The blank is folded along the inner pair of parallel lines 14 to form a flattened sleeve and the edge portions 12*a* of the blank are folded along the lines 15 and turned outwardly to form a seam 15*a* along the centre line 11 of the sleeve. The corners 12*b* of the edge portions are secured together by patches of adhesive 16 applied to one edge portion of the blank. The sides of the sleeve are adhered together along curved lines disposed in a generally diamond shape in a central region of the sleeve by curved bands 17, 18, of adhesive pre-applied to the blank.

Figure 2:
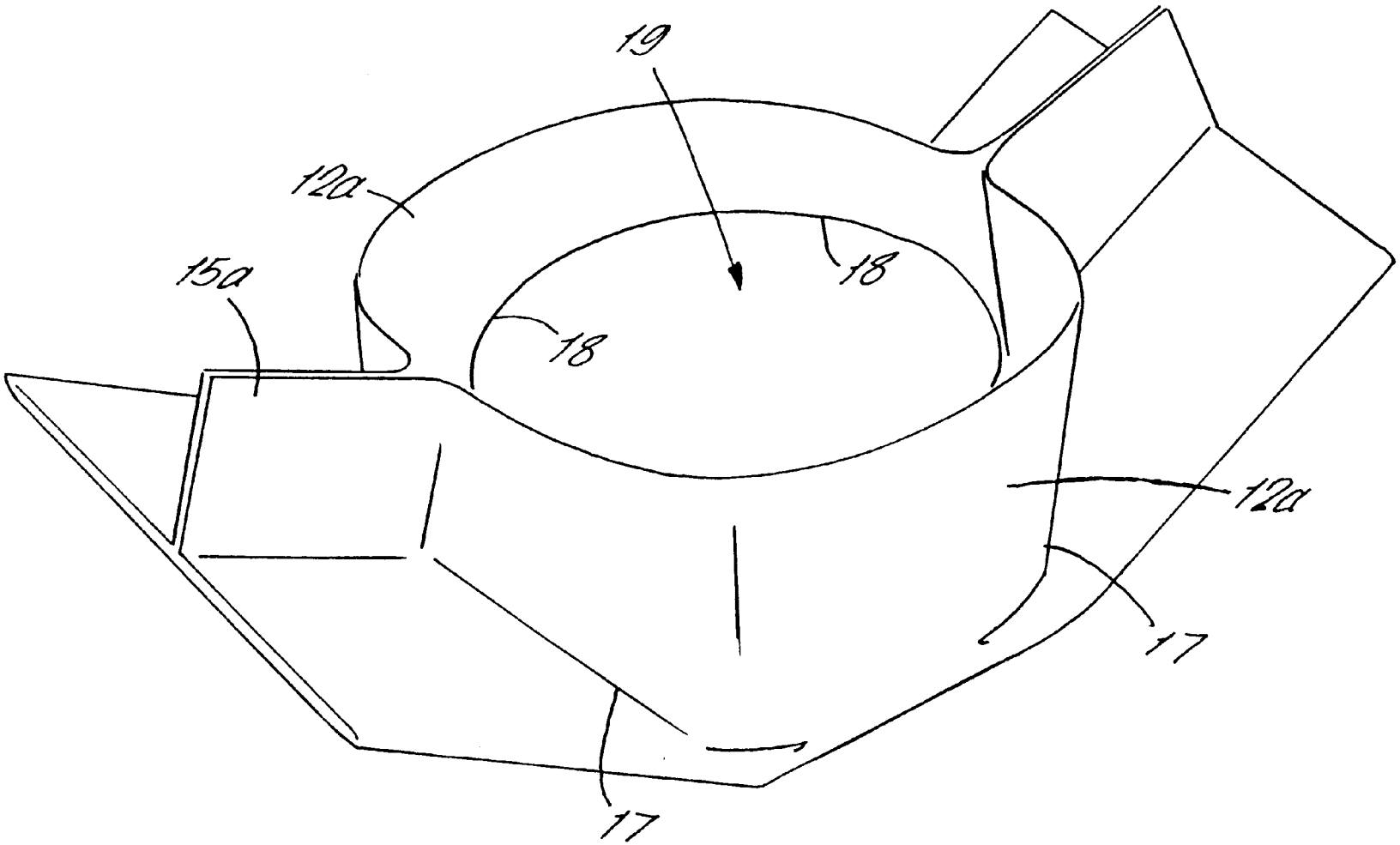
FIG. 2 shows the blank of FIG. 1 folded into a wrapper for an article such as a burger with an open receptacle for the article prior to closure.
Figure 3:
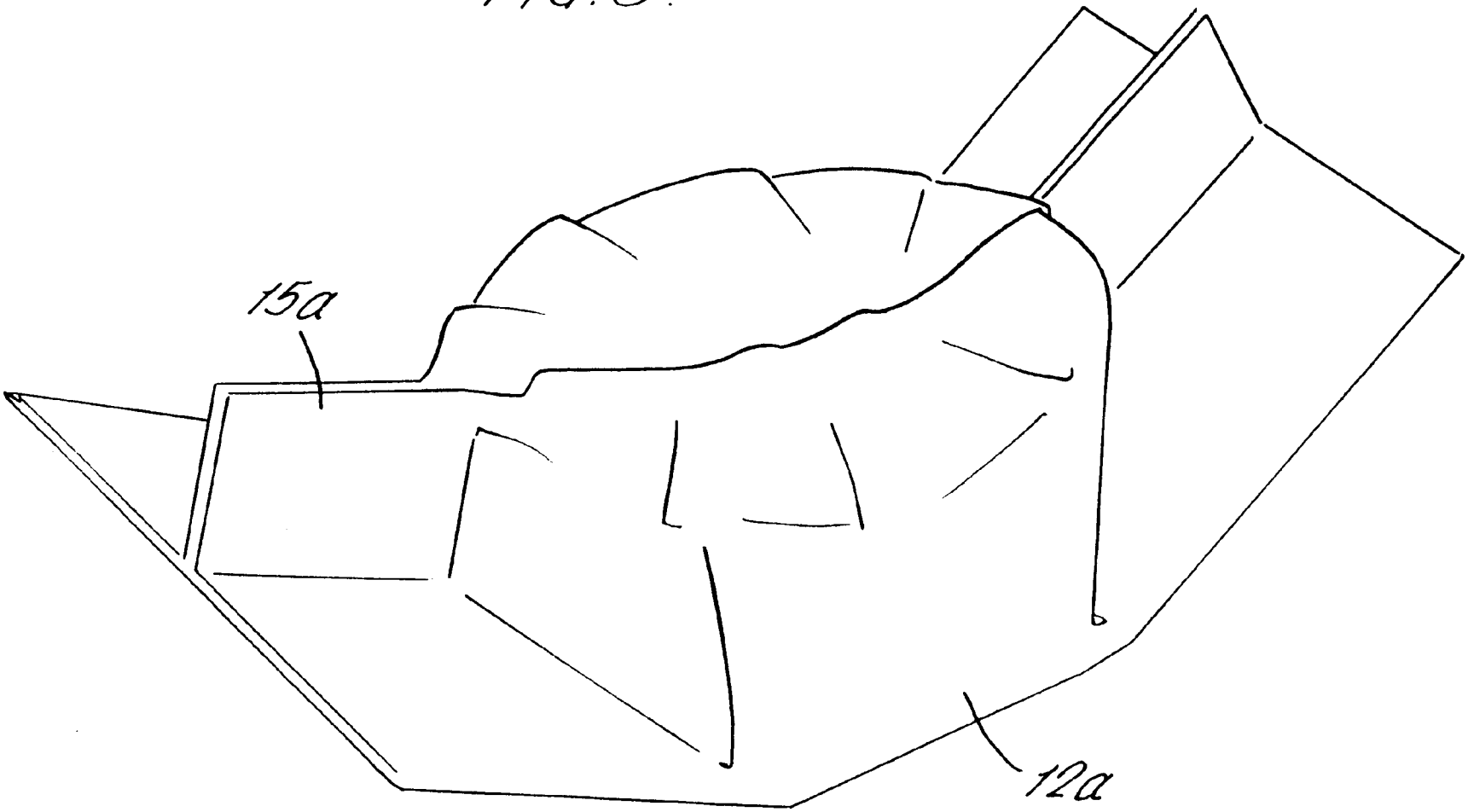
FIG. 3 shows the wrapper of FIG. 2 partially closed.
Figure 4:
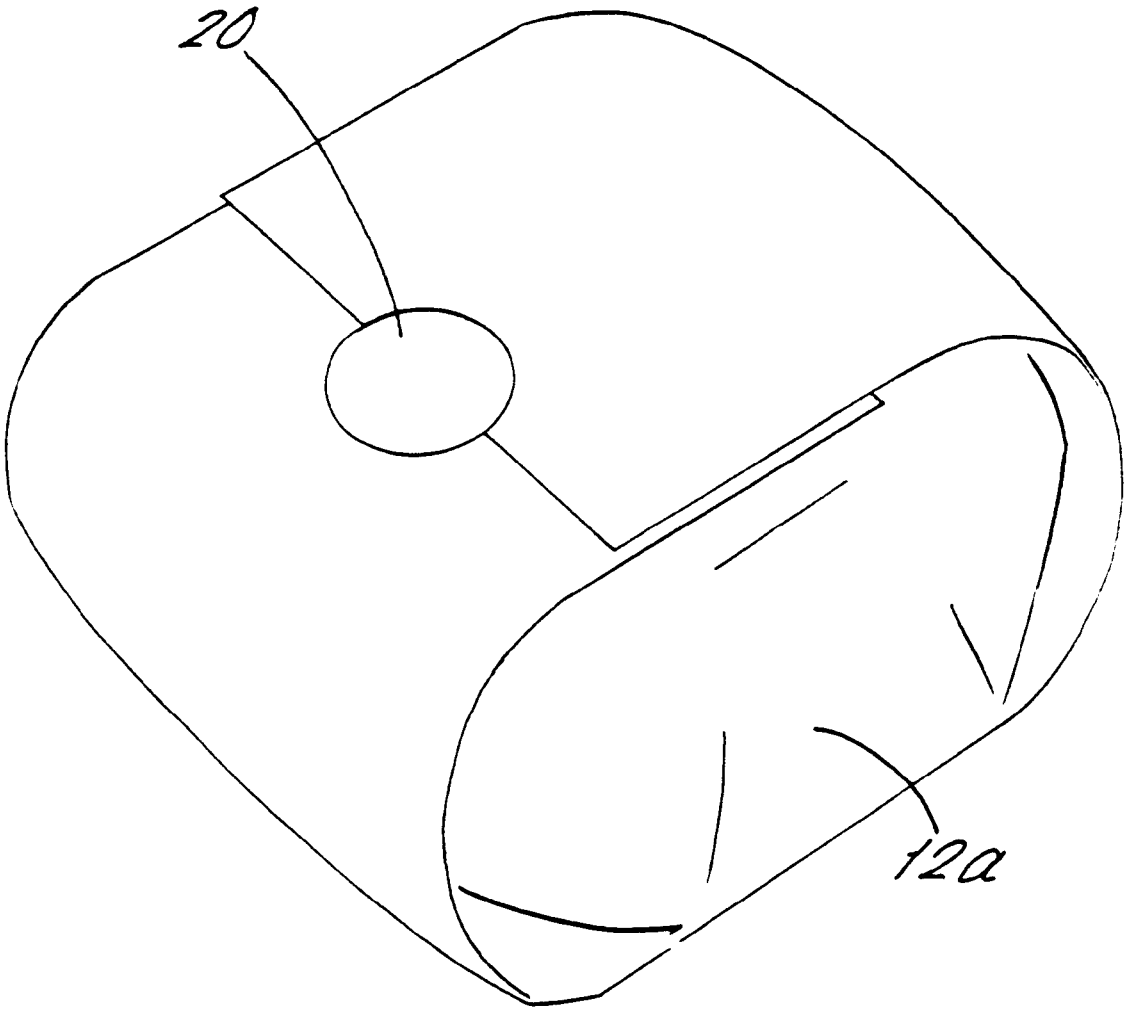
FIG. 4 shows the wrapper of FIGS. 2 and 3 fully closed with an adhesive label holding the wrapper closed.

The blank is folded in a sequence in which the edge portion 12*a* not carrying the adhesive patches 16 is first folded about line 14 to bring the bands of adhesive 18 into contact with the central region of the blank to one side of the centre line to adhere the sides of the blank together and the outer edge portion is folded outwardly about the line 15. The other portion of the blank is then folded about the line 14 to adhere to the bands of adhesive 17 to the central region and to adhere the patches 16 on the edge portion 12*a* to the corners 12*b* of the other edge portion to form a flattened sleeve with an out turned seam By separating the unadhered edge portions 12*a* of the blank a central cavity 19 of rounded diamond shape is formed defined between the adhered bands 17 and 18 and surrounded by the edge portions of the blank as illustrated in FIG. 2 to provide a receptacle for an article such as burger or the like. The edge portions of the blank are adhered together with one edge portion projecting slightly beyond the other to facilitate separation of the edge portions When the burger has been placed in the receptacle, the edge portions 12*a* in the central portion of the sleeve are folded over the burger as illustrated in FIG. 3 and the end parts of the sleeve are then folded over the central region in overlapping relationship and secured together by an adhesive tab 20 as illustrated in FIG. 4.

The arrangement thus provides a closed wrapping for the burger or other food product or article to protect the article. In the case of a food product, the wrapping can be opened by removing the adhesive tab and the cavity formed in the wrapping then provides a receptacle for the burger whilst it is being consumed.

Figure 5:
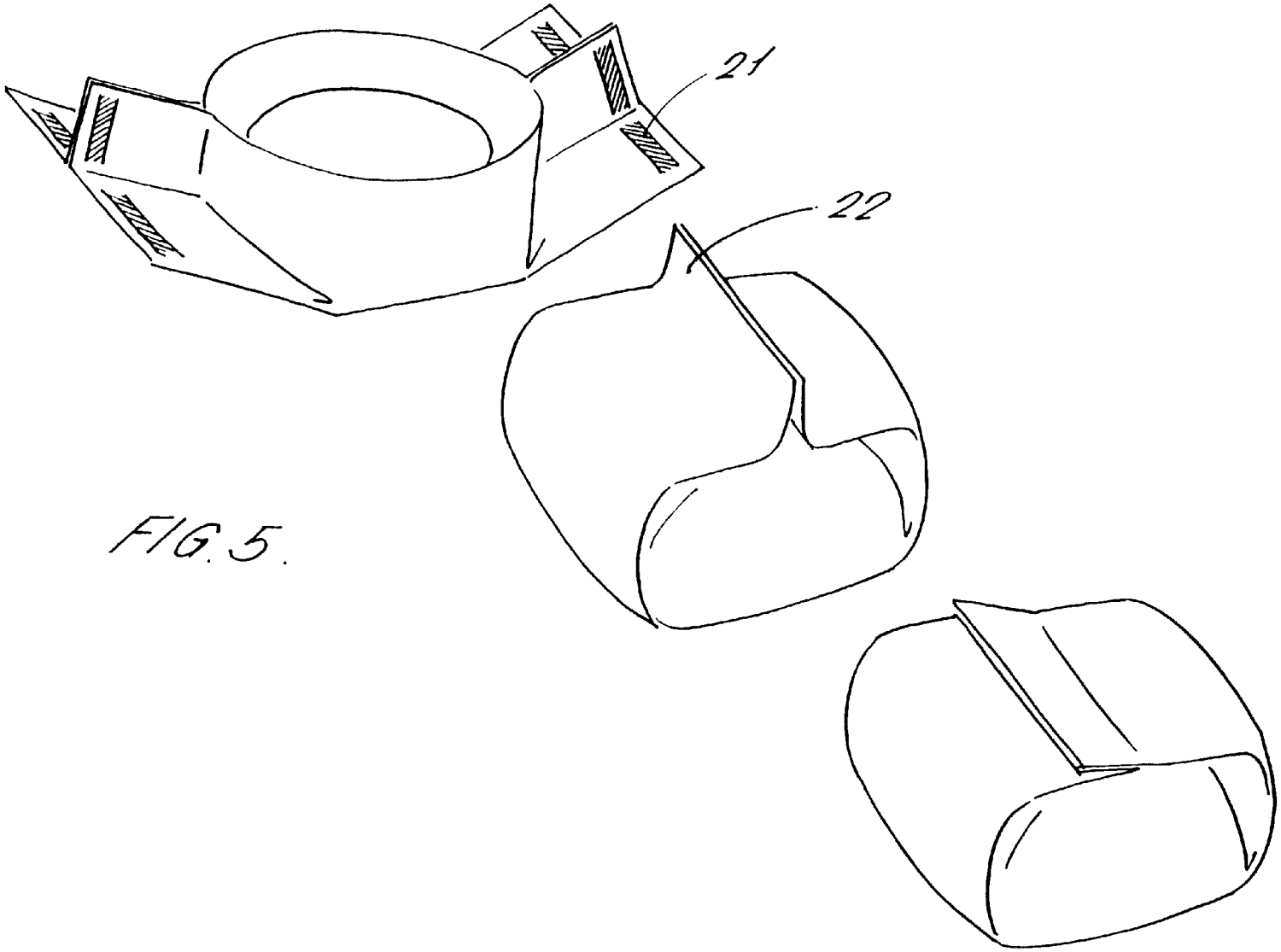
FIG. 5 shows another arrangement of contact adhesive strips applied to the wrapping for holding the wrapper closed.
Figure 6:
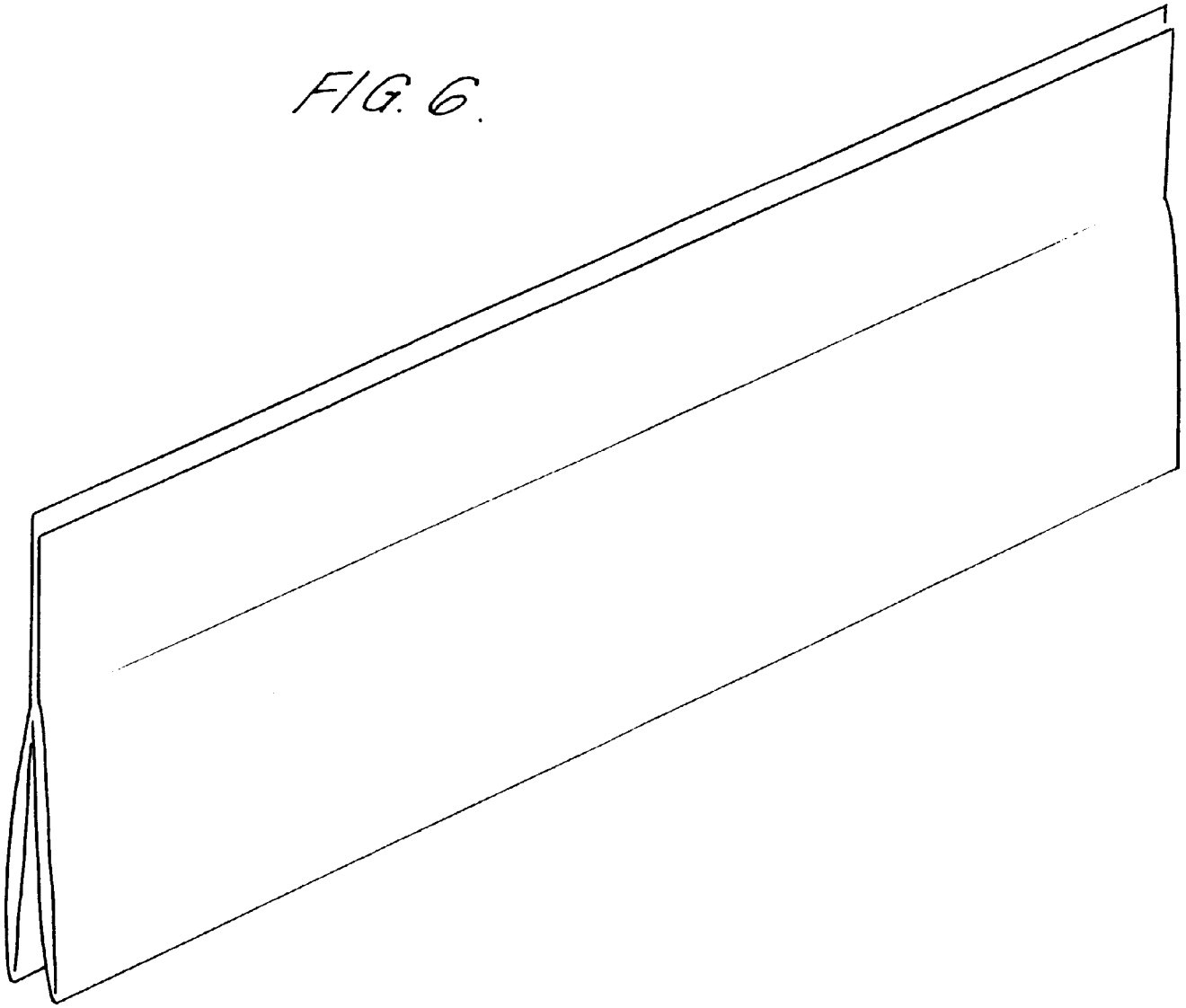
FIG. 6 shows a further arrangement of folding the wrapper before use.

FIG. 5 of the drawings shows a modified arrangement in which strips of contact adhesive 21 are applied to areas of the blank adjacent edges which can then be adhered together face to face as illustrated to form a seam indicated at 22 which can then be folded down as illustrated. The folded and adhered blank of FIG. 1 can be flattened along the fold lines 14 or along the centre line and fold lines 15 as illustrated in FIG. 6 in which case the seam formed by the edge portions of the blank lies generally in line with the remaining part of the blank.

Figure 7:
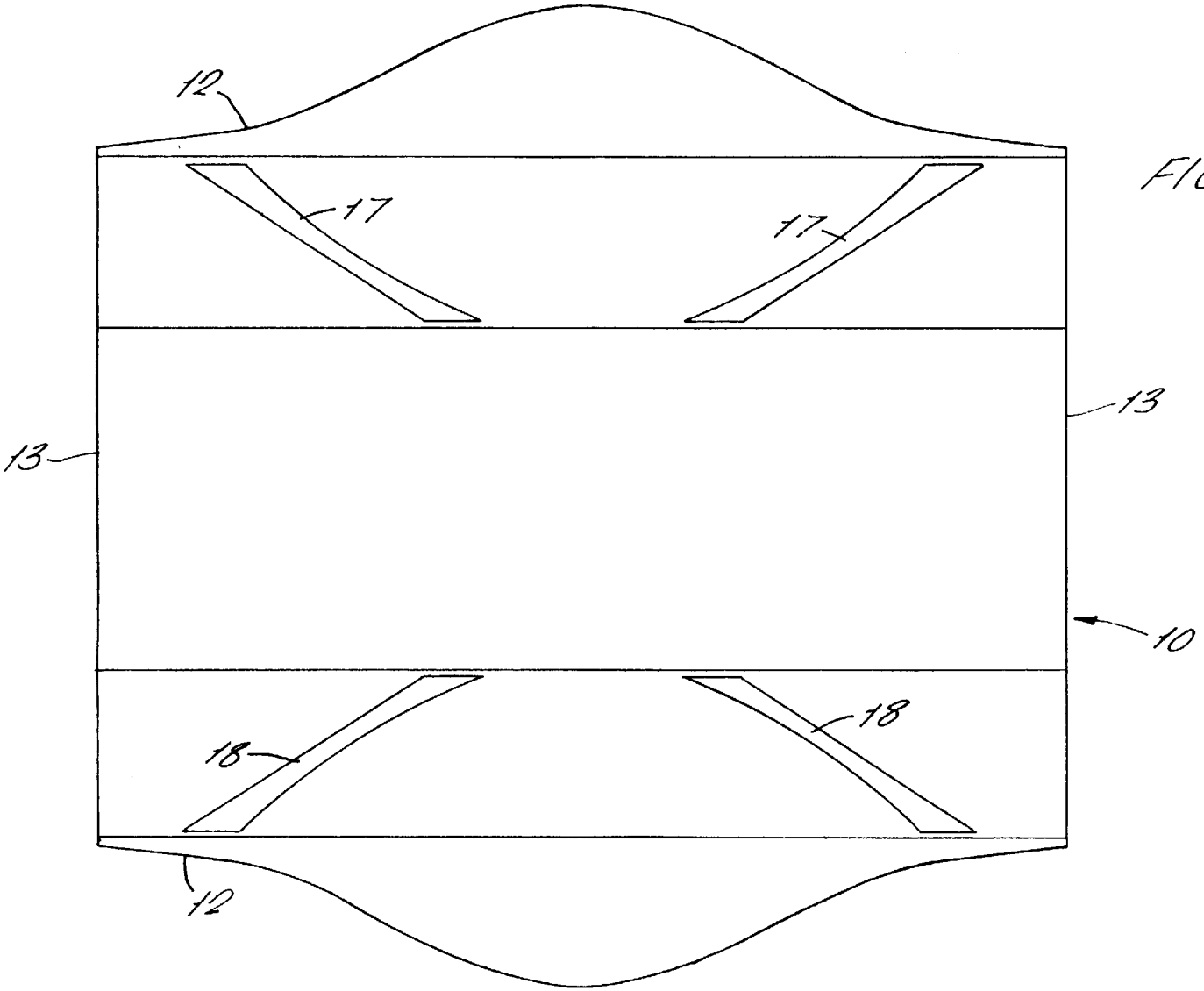
FIG. 7 shows a modified form of blank for a wrapper.

FIG. 7 is a further "modification" in which the side edges of the blank are cut away towards the ends 13 of the blank.

Figure 8:
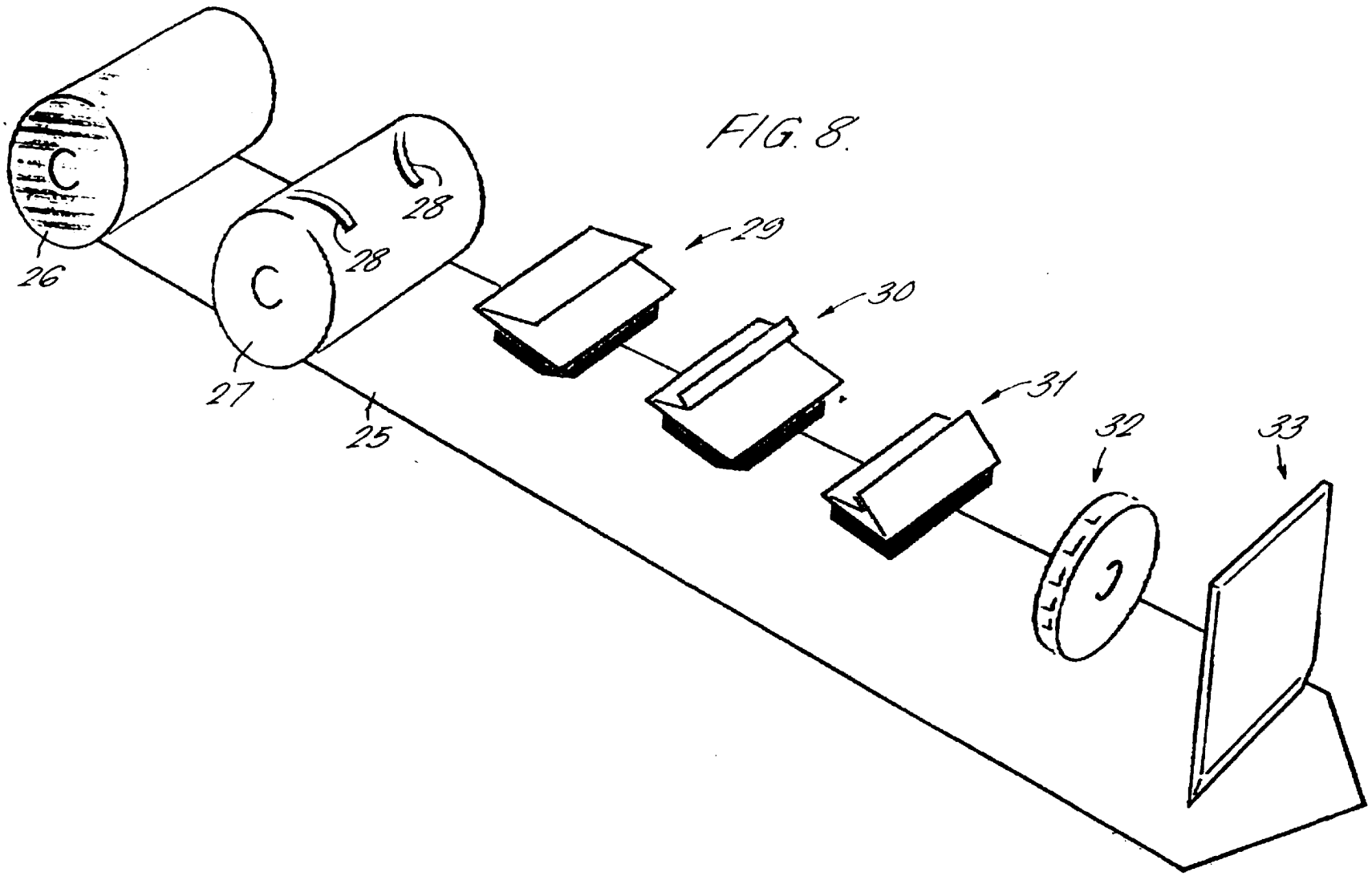
FIG. 8 is a diagrammatic illustration of an apparatus for forming a wrapper in accordance with the invention.

FIG. 8 illustrates a sequence of forming wrappers from web material 25 fed from a roll 26 passed a drum 27 carrying raised adhesive applying areas 28 and then through a sequence of stations illustrated at 29, 30 and 31 in which the blank is folded as described above. A wheel for applying a low tack adhesive is illustrated at 32 for applying contact adhesive in the end areas of the blank as illustrated in FIG. 5. A guillotine for separating or perforating the web where the wrappers are to be separated is illustrated at 33.

The arrangement provides a one piece construction for a wrapper formed out of paper, coated paper, printed paper, card or plastics material. The wrapper is formed by a series of folds and glue lines that create an enclosure shaped to hold a variety of products such as burgers and other take away foods, gifts, confectionery and even clothing items.

The construction is designed to be easily handled, folded and closed and will work well at high speeds required in industry such as general and fast foods. The fastening/closing of the wrapper may be facilitated by a label or negative and positive glue patches on each end of the wrapper.

The initial gluing of the blank referred to above may be provided by hot melt, cold melt or other adhesive or heat. Alternatively the blank may be formed from a heat sealable material and the edge portions and sides of the blank are then heat sealed together.

Figure 9:
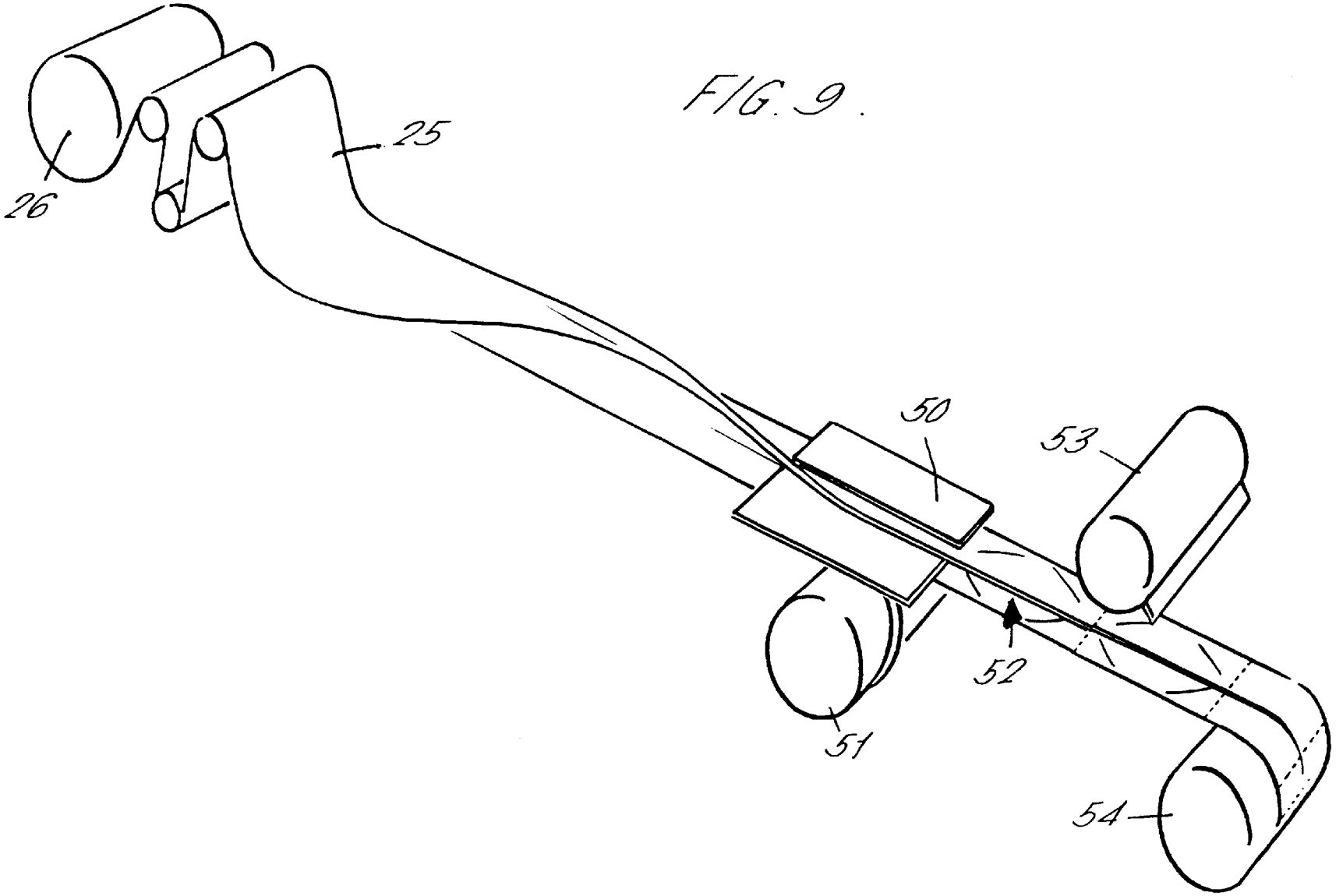
FIG. 9 is a similar view to FIG. 8 showing an alternative form of apparatus.

FIG. 9 shows a further form of apparatus for forming wrappers in accordance with the invention from heat sealable material. In this case a single folding station 50 is provided with a heated roller 51 having raised ribs located below the folding station to heat seal the webs together along the required pattern of lines to create the central enclosure as indicated at 52. The web is then perforated by a cutting roller 53 across the width of the web to enable it to be separated into appropriate lengths for wrappers and is taken up on a roller 54.

Figure 10:
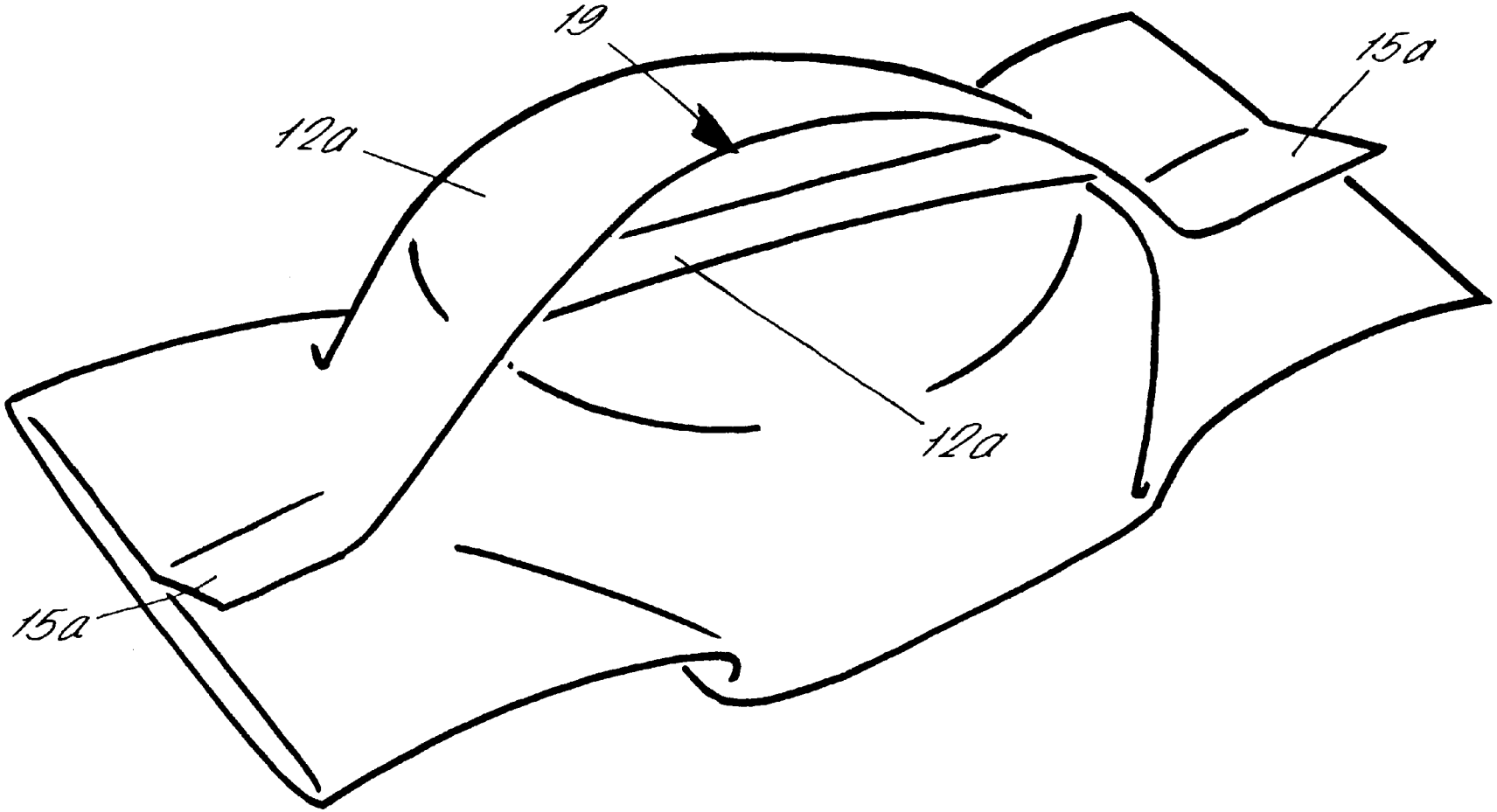
FIGS. 10 and 11 show another way of folding the wrapping.
Figure 11:
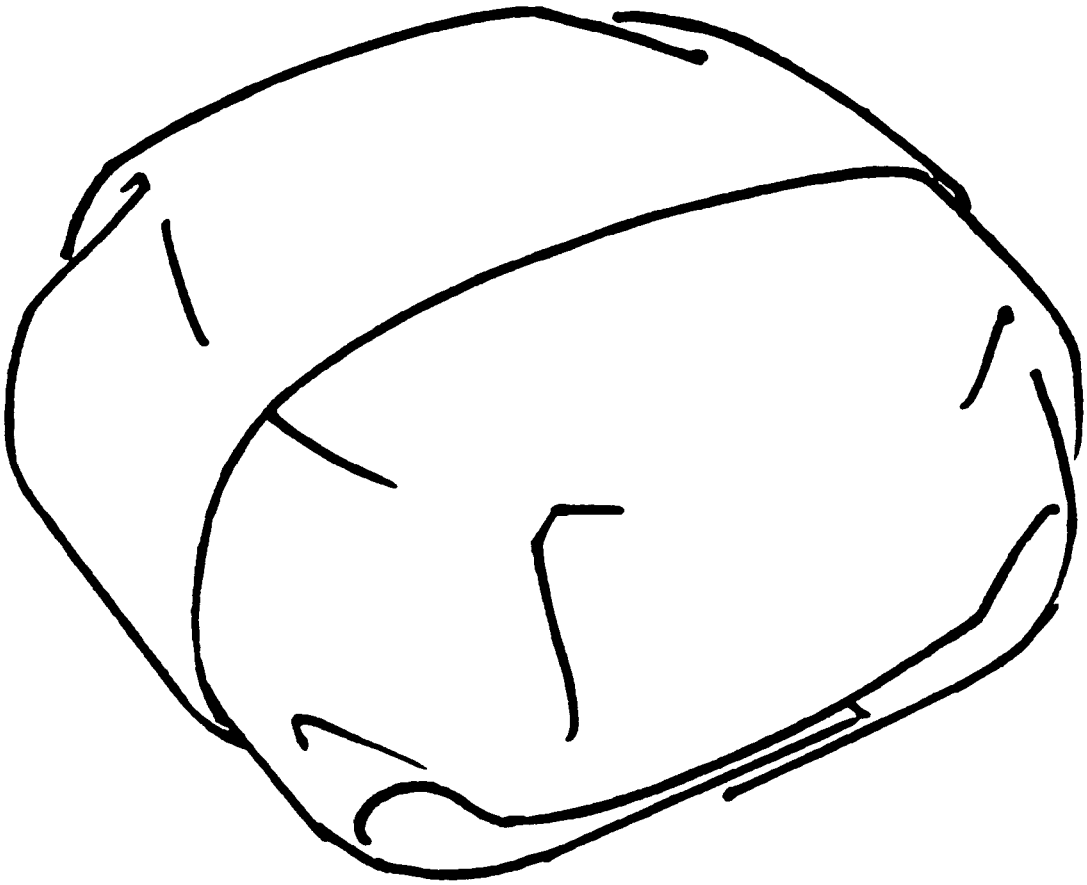

FIGS. 10 and 11 show an alternative way of finally wrapping a burger to that of FIG. 4.

A burger is placed in the receptacle 19 formed at the centre of the blank and the edge portions of the blank which have been previously adhered together at their end are folded over as shown in FIG. 10 to close the top of the central enclosure containing the burger. The end portions of the folded blank are then tucked under the bottom of the central enclosure as illustrated in FIG. 11 and the wrapped burger is then ready for presentation to the customer.

Figure 12:
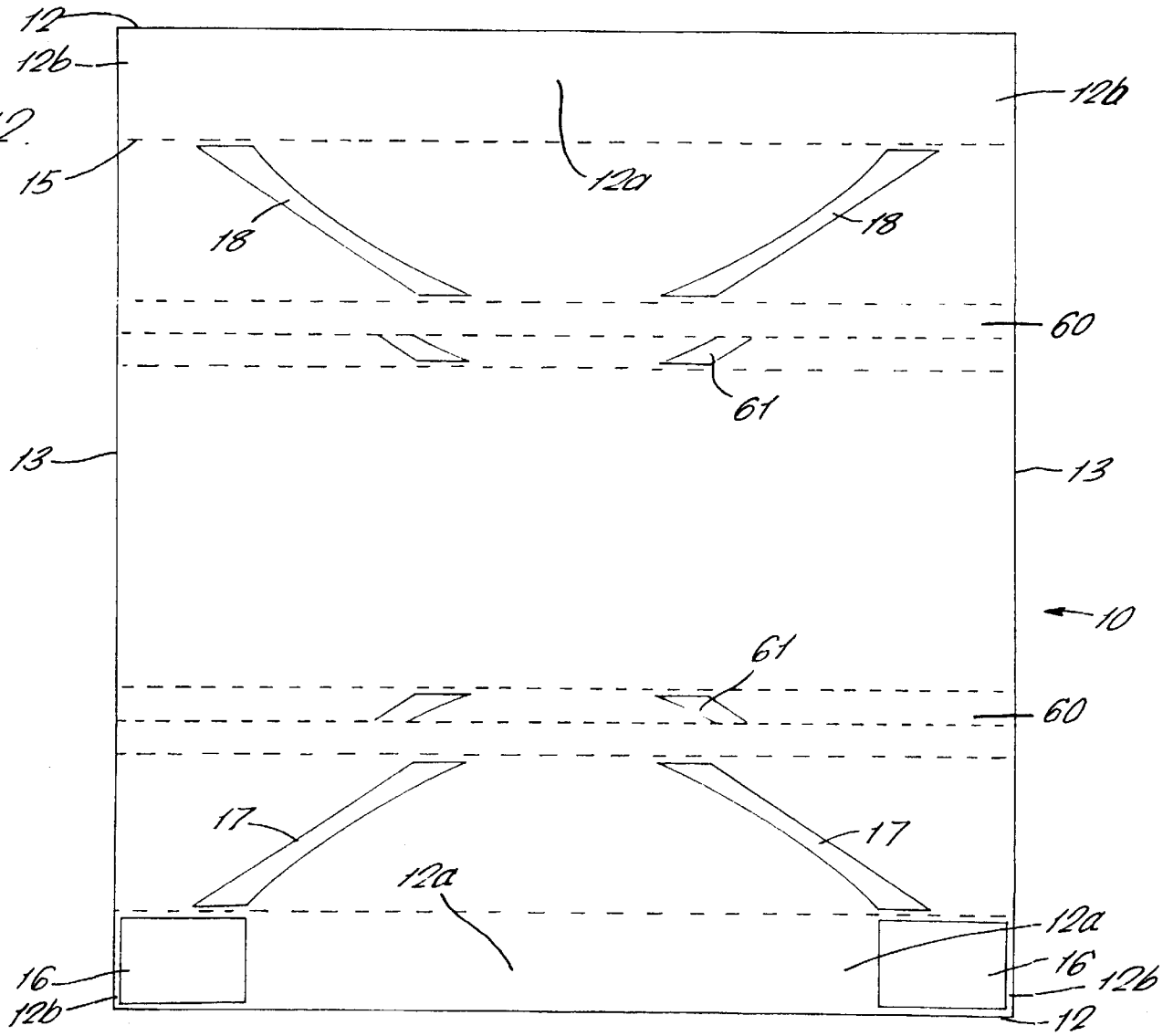
FIG. 12 shows a further form of blank from which the wrapper may be formed.

FIG. 12 shows a further form of blank having pairs of parallel pleats 60 extending along either side of the sleeve. The pleats are held on place by adhesive patches 61 located adjacent the central region of the sleeve and when opened provide an increased fullness in the enclosure.

Figure 13:
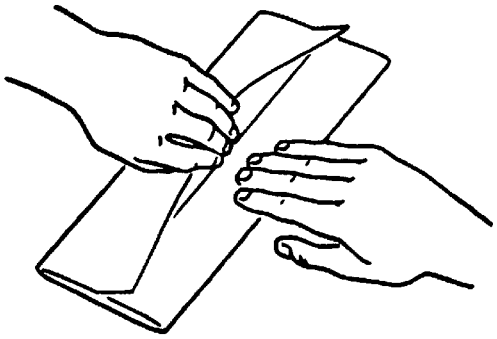
FIG. 13 shows the stage by stage preparation of the wrapper, placing of an article in the enclosure formed by the wrapper and closure of the wrapper.
Figure 13:
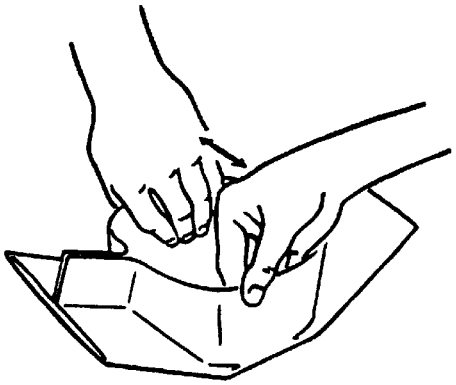
Figure 13:
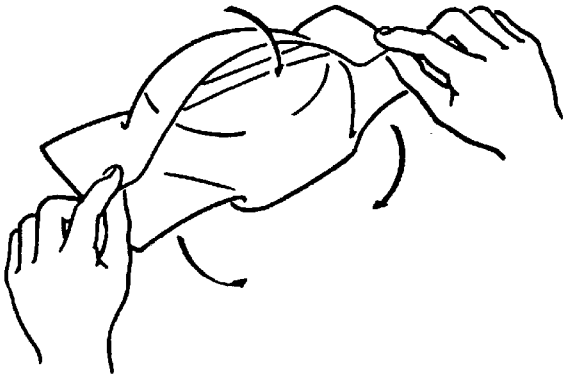
Figure 13:
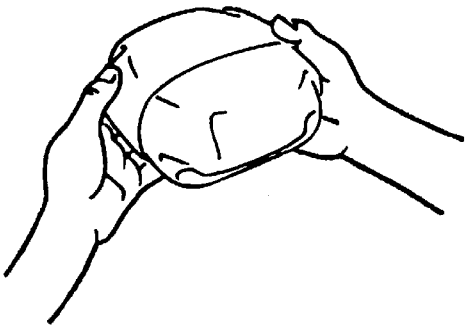

FIG. 13 shows a complete stage by stage preparation of the wrapper, forming the central enclosure and placing an article in it, closing over the central enclosure and completion of the wrapping.

The wrapper of the invention provides a flexible food wrap formed from a paper material which is adhered such as by heat sealing to form an enclosure for the food product of which can be closed over and wrapped around the food product to fully protect it. The wrapper is ideal for dispensing burgers, nuggets or cakes at point of purchase.

I claim:

1. A wrapper for an article comprising a sheet of wrapping material folded to form a flat sleeve with an out-turned central seam formed by opposed first and second edge portions of the flat sleeve extending along a central region of one side face of the sleeve, said edge portions being secured together at opposite first and second end portions of the sleeve and, at each side of the central seam, opposed surfaces of the sleeve being secured together along a pair of lines spaced inwardly from the opposite end portions and converging from the central seam in a manner to define, in a central region of the sleeve, the periphery of an article-receiving enclosure which can be opened by separating the opposed first and second edge portions of the central seam in the central region of the sleeve to receive an article and then be closed together and the end portions of the sleeve extending beyond the pairs of lines defining the periphery of the article-receiving enclosure and the end portions of the sleeve being adapted to be wrapped around the article-receiving enclosure in the central region of the sleeve.

2. A wrapper as claimed in claim 1 wherein the pair of lines at each side of the sleeve together define a generally diamond shaped periphery to the article-receiving enclosure.

3. A wrapper as claimed in claim 2, wherein the pair of lines at each side of the sleeve are convexly curved to form, together, the generally diamond shaped periphery with a rounded profile.

4. A wrapper as claimed in claim 1, wherein adhered parts of the sleeve are secured together along said pair of lines by bands of adhesive applied to at least one of the opposed surfaces of the sleeve.

5. A wrapper as claimed in claim 1, wherein the sleeve is formed from a rectangular sheet of wrapping material.

6. A wrapper as claimed in claim 1, wherein said first edge portion is arranged to extend beyond said second edge portion at the out-turned central seam, to facilitate separation of said first and second edge portions for opening the article-receiving enclosure.

7. A wrapper as claimed in claim 1, wherein the sleeve is formed with a pair of spaced longitudinally extending pleats extending along each side of said article-receiving enclosure to provide enhanced shape to said article-receiving enclosure.

8. A wrapper as claimed in claim 7, wherein each said spaced longitudinally extending pleat is held in place by adhesive adjacent said article-receiving enclosure.

9. A wrapper as claimed in claim 1, wherein said first and second end portions of the sleeve are wrapped over the article-receiving enclosure in the central region of the sleeve.

10. A wrapper as claimed in claim 1, wherein said first and second end portions of the sleeve are wrapped under the article-receiving enclosure in the central region of the sleeve.

11. A method of forming a wrapper for an article comprising the steps of:

feeding a web of sheet material through a plurality of stations, applying adhesive to a surface of the web at spaced locations along a first edge portion of the web and applying adhesive along pairs of curved convergent lines within a body of the web, folding the web so that a second edge portion of the web extends beyond a centre line of the web, folding the second edge portion back on itself in line with the centre line of the web, folding the web to form a flattened sleeve, with the adhesive applied to the surface of the web along the first edge portion of the web overlying a surface of the web along the second edge portion of the web, pressing together the surfaces along the first and second edge portions and pressing together opposed surfaces of the body of the web to adhere together the first and second edge portions and to adhere together the opposed surfaces of the sleeve along said pairs of curved convergent lines, and separating the folded wrapping from the web.

12. A method of forming a wrapper for an article comprising steps of:

feeding a web of heat sealable sheet material through a plurality of stations, folding a first side of the web so that a first edge portion of the web extends beyond a centre line of the web, folding the first edge portion back on itself in line with the centre line of the web, folding a second side of the web to form a flattened sleeve, with the first edge portion and a second edge portion of the web overlying each other, heat sealing ends of the first and second edge portions together, and heat sealing the first and second sides of the sleeve together along pairs of curved convergent lines in a central region of the sleeve to define a periphery of an article-receiving enclosure within the sleeve.

13. A wrapper as claimed in claim 1, wherein adhered parts of the sleeve are secured together along said pair of lines by heat sealing.

14. A wrapper as claimed in claim 4, wherein said bands of adhesive are applied to both opposed surfaces of the sleeve.

* * * * *